US009908139B2

(12) United States Patent
Hsu

(10) Patent No.: US 9,908,139 B2
(45) Date of Patent: Mar. 6, 2018

(54) TIMED GLUE GUN

(71) Applicant: Chia-Wen Hsu, Taichung (TW)

(72) Inventor: Chia-Wen Hsu, Taichung (TW)

( * ) Notice: Subject to any disclaimer, the term of this patent is extended or adjusted under 35 U.S.C. 154(b) by 0 days.

(21) Appl. No.: 15/131,619

(22) Filed: Apr. 18, 2016

(65) Prior Publication Data

US 2017/0128977 A1 May 11, 2017

(30) Foreign Application Priority Data

Nov. 9, 2015 (TW) ..... 104217900 U

(51) Int. Cl.
*B67D 1/00* (2006.01)
*B05C 17/005* (2006.01)
*G04F 3/06* (2006.01)

(52) U.S. Cl.
CPC ..... *B05C 17/0053* (2013.01); *B05C 17/0052* (2013.01); *B05C 17/00546* (2013.01); *G04F 3/06* (2013.01)

(58) Field of Classification Search
CPC ..... B05C 17/0053; B05C 17/00546; B05C 17/00526; G04F 3/06
USPC ..... 222/39, 146.5; 219/229
See application file for complete search history.

(56) References Cited

U.S. PATENT DOCUMENTS 3,612,357 A * 10/1971 Ruskin ..... B05C 17/0053 219/230
4,493,972 A * 1/1985 Steinel ..... B05C 17/00546 219/230
4,546,235 A * 10/1985 Kolter ..... B05C 17/00546 219/230
4,729,442 A * 3/1988 Sichet ..... G01G 11/12 177/123
4,826,049 A * 5/1989 Speer ..... B25H 3/006 200/51.09
5,362,164 A * 11/1994 Wingert ..... B05C 17/00526 219/505
5,462,206 A * 10/1995 Kwasie ..... B05C 17/0053 222/146.5
5,688,421 A * 11/1997 Walton ..... B05C 17/00526 219/230
5,897,207 A * 4/1999 Hartmann ..... F25D 29/008 116/216
6,105,824 A * 8/2000 Singleton ..... B05C 17/0053 219/221
6,524,102 B2 * 2/2003 Davis ..... A61C 9/0006 222/146.5
6,616,448 B2 * 9/2003 Friedman ..... A61C 5/62 433/32

(Continued)

*Primary Examiner* — Benjamin R Shaw
(74) *Attorney, Agent, or Firm* — LeClairRyan

(57) ABSTRACT

A timed glue gun includes a glue pushing unit including a trigger, a glue pushing member and a heating member for melting the hot melt glue stick, and a control unit including a timing member and an alarm member. The trigger is at a released position, and is operable to be pressed to a triggered position. The timing member starts to count upwards from zero when the heating member starts to heat up, and controls the alarm member to emit a first alarm signal when counting to a first elapsed time. The alarm member emits a second alarm signal when the timing member counts to a second elapsed time longer than the first elapsed time in response to continuous location of the trigger at the released position for the second elapsed time during heating of the heating member.

8 Claims, 1 Drawing Sheet

(56) References Cited

U.S. PATENT DOCUMENTS

| | | | | |
|---|---|---|---|---|
| 2006/0081650 | A1* | 4/2006 | Axinte | B05C 17/00526 222/146.2 |
| 2006/0191957 | A1* | 8/2006 | Axinte | B05C 17/00526 222/146.5 |
| 2008/0041880 | A1* | 2/2008 | Babineau | A23G 1/202 222/146.5 |
| 2008/0135644 | A1* | 6/2008 | Mangelsen | B05C 17/00526 239/296 |
| 2015/0209820 | A1* | 7/2015 | Ono | B05C 17/00546 222/80 |
| 2016/0109858 | A1* | 4/2016 | Oetken | E01C 19/288 404/84.05 |

* cited by examiner

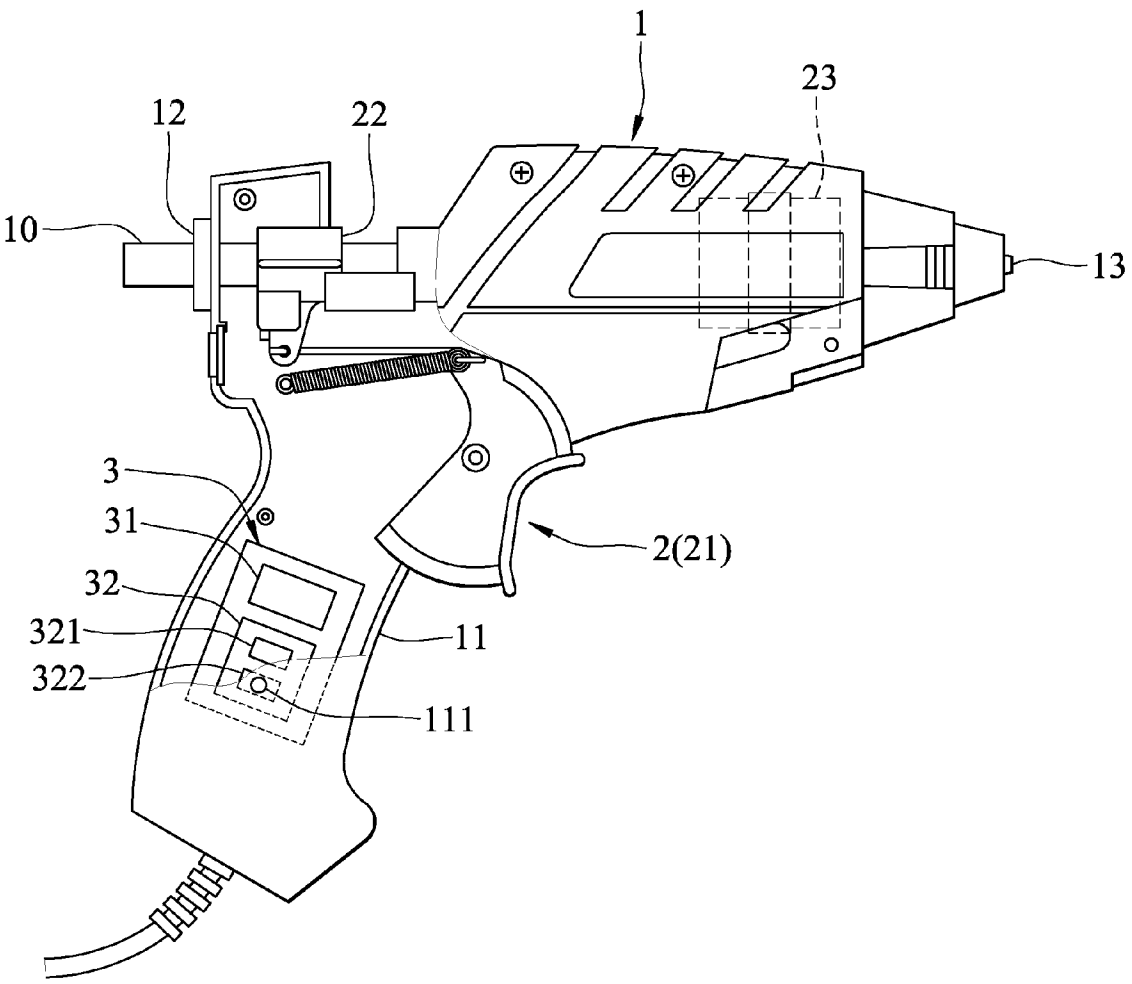
13
23
1
22
12
10
2(21)
11
111
3
31
32
321
322

TIMED GLUE GUN

CROSS-REFERENCE TO RELATED APPLICATION

This application claims priority of Taiwanese Patent Application No. 104217900, filed on Nov. 9, 2015.

FIELD

The disclosure relates to a glue gun, more particularly to a timed glue gun.

BACKGROUND

U.S. Pat. No. 6,105,824 discloses an auto shut-off glue gun that includes a timing controller, a heating element, and a trigger. Upon release of the trigger, the timing controller turns off the heating element after a predetermined amount of time.

The timing controller includes an AC to DC converter, a reset switch, a time constant circuit, a reference voltage circuit, an operational amplifier, and a switching element. The reset switch is controlled by the trigger to be switched between an open position and a close position. The time constant circuit is connected in series to the reset switch, and is capable of generating a timing voltage. The reference voltage circuit is capable of generating a reference voltage. The operational amplifier is electrically connected to the time constant circuit and the reference voltage circuit. The witching element is electrically connected to an output end of the operational amplifier. The operational amplifier receives the timing voltage and the reference voltage, and outputs a control signal that is proportional to the difference between the timing voltage and the reference voltage. The witching element receives the control signal and is switched between a flow permitting position and a flow preventing position according to the control signal.

When the trigger is pressed, the reset switch is switched to the open position, and the time constant circuit is charged and outputs the timing voltage that is greater than the reference voltage. The operational amplifier receives the timing voltage and the reference voltage, and outputs the control signal of high value to switch the witching element to the flow permitting position. As a result, the AC to DC converter outputs a signal to turn on the heating element.

When the trigger is released, the reset switch is switched to the close position, and the time constant circuit is discharged and outputs the timing voltage that has a voltage value decreasing with time. When the timing voltage is equal to the reference voltage (i.e., the difference between the timing voltage and the reference voltage is zero), the operational amplifier outputs the control signal of low value to switch the witching element to the flow preventing position. As a result, the AC to DC converter stops outputting the signal to the heating element, and the heating element is turned off.

The complicated controlling mechanism of the auto shut-off glue gun greatly increases manufacturing and maintaining costs of the auto shut-off glue gun.

SUMMARY

Therefore, an object of the present disclosure is to provide a timed glue gun that can alleviate at least one of the drawbacks associated with the prior art.

According to the present disclosure, a timed glue gun is used for melting a hot melt glue stick into a molten glue and applying the molten glue to an object.

The timed glue gun includes a housing, a glue pushing unit, and a control unit.

The housing has a grip portion, a glue inlet opening, and a glue outlet opening. The grip portion is used to be grasped by a user. The glue inlet opening and the glue outlet opening are respectively formed at two opposite ends of the housing, so as to permit the hot melt glue stick to be inserted into the glue inlet opening, and permit the molten glue to flow out of the timed glue gun through the glue outlet opening.

The glue pushing unit includes a trigger, a glue pushing member, and a heating member, The trigger is disposed on the housing at a released position and is operable to be pressed to a triggered position. The heating member is disposed in the housing for melting the hot melt glue stick into the molten glue. The glue pushing member is disposed in the housing for pushing the hot melt glue stick toward the glue outlet opening when the trigger is pressed to the triggered position, after which the glue pushing member stops pushing the hot melt glue stick in response to movement of the trigger to the released position.

The control unit is disposed in the housing and includes a timing member and an alarm member.

The timing member starts to count upwards from zero when the heating member starts to heat up, and controls the alarm member to emit a first alarm signal when the timing member counts to a first elapsed time.

The timing member controls the alarm member to emit a second alarm signal when the timing member counts to a second elapsed time longer than the first elapsed time in response to continuous location of the trigger at the released position for the second elapsed time during heating of the heating member.

BRIEF DESCRIPTION OF THE DRAWINGS

Other features and advantages of the present disclosure will become apparent in the following detailed description of the embodiment(s) with reference to the accompanying drawing, of which:

FIG. 1 is a schematic view of an embodiment of a timed glue gun according to the present disclosure.

DETAILED DESCRIPTION

Referring to FIG. 1, an embodiment of a timed glue gun is used for melting a hot melt glue stick 10 into a molten glue (not shown) and applying the molten glue to an object (not shown). The timed glue gun includes a housing 1, a glue pushing unit 2, and a control unit 3.

The housing 1 has a grip portion 11, a glue inlet opening 12, and a glue outlet opening 13. The grip portion 11 is used to be grasped by a user, and is formed with a through hole 111. The glue inlet opening 12 and the glue outlet opening 13 are respectively formed at two opposite ends of the housing 1, so as to permit the hot melt glue stick 10 to be inserted into the glue inlet opening 12, and permit the molten glue to flow out of the timed glue gun through the glue outlet opening 13.

The glue pushing unit 2 includes a trigger 21, a glue pushing member 22, and a heating member 23. The trigger 21 is disposed on the housing 1 at a released position and is operable to be pressed to a triggered position. The heating member 23 is disposed in the housing 1 for melting the hot melt glue stick 10. The glue pushing member 22 is disposed in the housing 1 for pushing the hot melt glue stick 10 toward the glue outlet opening 13 when the trigger 21 is pressed to the triggered position, after which the glue pushing member 22 stops pushing the hot melt glue stick 10 in response to movement of the trigger 21 to the released position. The connection mechanism between the trigger 21 and the glue pushing member 22 is well known in the art and is not of the essence of this disclosure. Therefore, the connection mechanism is not further elaborated hereinafter for the sake of brevity.

The control unit 3 is disposed in the grip portion 11 of the housing 1, and includes a timing member 31 and an alarm member 32.

The timing member 31 starts to count upwards from zero when the heating member 23 starts to heat up, and controls the alarm member 32 to emit a first alarm signal when the timing member 31 counts to a first elapsed time. In this embodiment, the first elapsed time is a minimum time required for the hot melt glue stick 10 to be melted into the molten glue. In certain embodiments, the first elapsed time is a minimum time required for the heating member 23 to reach a temperature of 180° C., and after the first elapsed time, the heating member 23 is maintained at a temperature ranging from 180° C. to 200° C., which is a suitable range for melting the hot melt glue stick 10 that is commonly used in the art. As a result, the first alarm signal acts as a reminder that at least a part of the hot melt glue stick 10 is melted into the molten glue, and the timed glue gun is ready to be used.

In this embodiment, the timing member 31 controls the alarm member 32 to emit a second alarm signal when the timing member 31 counts to a second elapsed time that is longer than the first elapsed time in response to continuous location of the trigger 21 at the released position for the second elapsed time during heating of the heating member 23. To be more specific, the timing member 31 stops counting when the trigger 21 is pressed to the triggered position during heating of the heating member 23, after which the timing member 31 starts to count from zero in response to movement of the trigger 21 to the released position, and controls the alarm member 32 to emit the second alarm signal when the timing member counts to the second elapsed time. Therefore, the second alarm signal acts as a reminder that, during heating of the heating member 23, when the timed glue gun is not used (i.e., the trigger 21 is kept at released position) for a time equal to or longer than the second elapsed time, the alarm member 32 emits the second alarm signal as a safety reminder.

In this embodiment, the alarm member 32 includes an acoustic alarm 321 and a visual alarm 322. The acoustic alarm 321 is capable of emitting the first alarm signal and the second alarm signal. The visual alarm 322 is capable of emitting the first alarm signal and the second alarm signal out of the grip portion 11 through the through hole 111, and corresponds in position to the through hole 111, thereby allowing the user to see the visual alarm 322. In certain embodiments, the acoustic alarm 321 is a buzzer, and the visual alarm 322 is a light-emitting diode.

The merits of the timed glue gun are summarized below.

The alarm member 32 of the timed glue gun of this disclosure is capable of emitting the first and second alarm signals that are respectively a reminder noticing that the timed glue gun is ready to be used, and a safety reminder warning that, when the heating member 23 is heating, the timed glue gun is not used for the second elapsed time, thereby achieving a simple design that shows the status of the timed glue gun, and increasing the safety of the timed glue gun.

The alarm member 32 includes the acoustic alarm 321 and the visual alarm 322, thereby sending both acoustic and visual alarm signals to the user.

With the combination of the timing member 31, the buzzer, and the light-emitting diode, the manufacturing cost of the timed glue gun is reduced.

The first elapsed time equals to the minimum time required for the hot melt glue stick 10 to be melted into the molten glue. Therefore, upon receiving the first alarm signal, the user is aware that at least the part of the hot melt glue stick 10 is melted into the molten glue, and is suitable to be used for gluing or other applications.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A timed glue gun adapted for melting a hot melt glue stick into a molten glue and applying the molten glue to an object, said timed glue gun comprising:

a housing that has a grip portion, a glue inlet opening and a glue outlet opening, said grip portion being adapted to be grasped by a user, said glue inlet opening and said glue outlet opening being respectively formed at two opposite ends of said housing, so as to permit the hot melt glue stick to be inserted into said glue inlet opening, and permit the molten glue to flow out of said timed glue gun through said glue outlet opening;

a glue pushing unit that includes a trigger, a glue pushing member and a heating member, said trigger being disposed on said housing at a released position and being operable to be pressed to a triggered position, said heating member being disposed in said housing for melting the hot melt glue stick into the molten glue, said glue pushing member being disposed in said housing for pushing the hot melt glue stick toward said glue outlet opening when said trigger is pressed to the triggered position, after which said glue pushing member stops pushing the hot melt glue stick in response to movement of said trigger to the released position; and a control unit that is disposed in said housing and that includes a timing member and an alarm member, wherein, said timing member starts to count upwards from zero when said heating member starts to heat up, and controls said alarm member to emit a first alarm signal when said timing member counts to a first elapsed time, and said timing member controls said alarm member to emit a second alarm signal when said timing member counts to a second elapsed time longer than the first elapsed time in response to continuous location of said trigger at said released position for the second elapsed time during heating of said heating member.

2. The timed glue gun as claimed in claim 1, wherein said timing member stops counting when said trigger is pressed to the triggered position during heating of said heating member, after which said timing member starts to count upwards from zero in response to movement of said trigger to the released position, and controls said alarm member to emit the second alarm signal when said timing member counts to the second elapsed time.

3. The timed glue gun as claimed in claim 1, wherein said alarm member includes an acoustic alarm that is capable of emitting the first alarm signal and the second alarm signal.

4. The timed glue gun as claimed in claim 3, wherein said acoustic alarm is a buzzer.

5. The timed glue gun as claimed in claim 1, wherein said grip portion of said housing is formed with a through hole, said control unit being disposed in said grip portion, said alarm member including a visual alarm that is capable of emitting the first alarm signal and the second alarm signal out of said grip portion through said through hole, and that corresponds in position to said through hole, thereby allowing the user to see said visual alarm.

6. The timed glue gun as claimed in claim 5, wherein said visual alarm is a light-emitting diode.

7. The timed glue gun as claimed in claim 1, wherein the first elapsed time is a minimum time required for said heating member to reach a temperature of 180° C.

8. The timed glue gun as claimed in claim 7, wherein, after the first elapsed time, said heating member is maintained at a temperature ranging from 180° C. to 200° C.

* * * * *